United States Patent [19]

Nakamori et al.

[11] Patent Number: 4,849,605

[45] Date of Patent: Jul. 18, 1989

[54] HEATING RESISTOR AND METHOD FOR MAKING SAME

[75] Inventors: Tomohiro Nakamori; Taiji Tsuruoka; Susumu Shibata; Takashi Kanamori, all of Tokyo, Japan

[73] Assignee: Oki Electric Industry Co., Ltd., Tokyo, Japan

[21] Appl. No.: 167,241

[22] Filed: Mar. 11, 1988

[51] Int. Cl.[4] ..... B41J 3/20; H05B 3/12

[52] U.S. Cl. ..... 219/216; 346/76 PH; 219/543

[58] Field of Search ..... 219/216 PH, 543; 338/307, 308, 309, 314; 346/76 PH; 400/120; 252/504, 507, 516, 520

[56] References Cited

U.S. PATENT DOCUMENTS

| | | | |
|---|---|---|---|
| 4,173,731 | 11/1979 | Takagi | 252/507 |
| 4,232,213 | 11/1980 | Taguchi | 338/309 |
| 4,682,143 | 7/1987 | Chu | 338/308 |
| 4,732,701 | 3/1988 | Nishii | 252/516 |
| 4,753,903 | 6/1988 | Saito | 252/516 |

FOREIGN PATENT DOCUMENTS

| | | | |
|---|---|---|---|
| 57-83475 | 5/1982 | Japan | 219/216 PH |
| 58-147382 | 9/1983 | Japan | 219/216 PH |

OTHER PUBLICATIONS

Tomohiro Nakamori, Taiji Tsuruoka, Susumu Shibata, "Ta-Si-C High Resistivity Thin Films For Thermal Printing Heads", lectured on Mar. 27, 1987 at Keio University, published in a Report by OKI Electric Industry Co., Ltd. on Mar. 15, 1987. (English)

Tomohiro Nakamori, Yasuharu Tsuruoka, Takashi Kanamori, Susumu Shibata, "High Resistivity Thin Films for Thermal Printing Head Heating Elements", lectured on Jul. 24, 1987 at Aoyama Gakuin, University, published same date. (English translation)

Tomohiro Nakamoti, Taiji Tsuruoka, Takashi Kanamori, Susumu Shibata "Effect of Film Thickness and Heat Treatment on Ta-Si-C Thin Films for Thermal Printing Heads", published by OKI Electric Industry Co., Ltd. on Oct. 17, 1987. (English translation)

Tomohiro Nakamori, Taiji Tsuruoka, Takashi Kanamori and Susumu Shibata, "Effect of Film Thickness on Ta-Si-C High Resistivity Thin Films for Thermal Printing Heads", in The Transactions of the IEICE (vol. E 70, No. 11, Nov. 1987), pp. 1133-1139.

Tomohiro Nakamori, Taiji Tsuruoka Takashi Kanamori, and Susumu Shibata, "Ta-Si-C High Resistivity Thin Films for Thermal Printing Heads," in IEEE Transactions on Components, Hybrids, and Manufacturing Technology (vol. CHMT-10, No. 3, Sep. 1987), pp. 446-451.

*Primary Examiner*—Teresa J. Walberg

*Attorney, Agent, or Firm*—Wenderoth, Lind & Ponack

[57] ABSTRACT

A heating resistor includes a conductive material, and an electrically insulating material made of a mixture of silicon carbide (SiC) and carbon (C) having a carbon content of not less than 3 wt % based on the mixture. The resistor is formed by sputtering of a target of the conductive material and the electrically insulating material having at least 5 wt % of carbon. The conductive material and the electrically insulating material may be respectively provided as separate targets. The conductive material is at least one metal selected from tantalum, niobium, titanium, tungsten, molybdenum, zirconium and chromium.

2 Claims, 4 Drawing Sheets

HEATING RESISTOR AND METHOD FOR MAKING SAME

BACKGROUND OF THE INVENTION

1. Field of the Invention

This invention relates to heating elements such as thermal printing heads, heaters and the like, and more particularly to heating resistors used in the heating elements. The invention also relates to a method for making such heating resistors.

2. Description of the Prior Art

Heating resistors made of a variety of materials have been hitherto proposed for use in heaters or thermosensitive heads. In recent years, attention has been particularly drawn to the application of such a heating resistor to a thin film thermal printing head. The thin film thermal printing head (hereinafter referred to simply as thermal printing head) is used to cause a thermosensitive paper to be developed in color in the form of desired mosaic patterns of dots so as to print pictures, letters or characters on the paper according to information signals. For this purpose, a number of structures for the thermal printing head have been proposed as described, for example, in "Kinzoku Hyomen Gijitsu (Journal of Metal Finishing society of Japan)" 34, (6) (1983, P. 271–277).

According to the literature cited above, a heating resistor used for the above purpose is predominantly made of tantalum nitride ($Ta_2N$) in which tantalum serves as a conductive material and nitrogen is used as an electrically insulating material. The use of tantalum nitride ($Ta_2N$) in a known heating resistor is described with reference to FIGS. 5, 6*a* and 6b.

FIG. 5 is a schematic sectional view showing an essential part of a thermal printing head using a conventional tantalum nitride ($Ta_2N$) heating resistor. In the figure, only one heating resistor mounted on an insulating substrate is sectionally shown although a thermal printing head has a great number of heating resistors therein. The thermal printing head includes an insulating substrate 11 made, for example, of an alumina ceramic or similar insulating material, and a heating resistor 13 of tantalum nitride ($Ta_2N$) formed on the insulating substrate 11. Electric conductors 15, 17, which are, respectively, made of gold and/or chromium, are formed on the heating resistor 13. An oxidation-resistant film 21 made, for example, of silicon carbide (SiC) is provided over the heating resistor 13 and the conductors 15, 17 in order to prevent deterioration of the tantalum nitride heating resistor 13. Over the oxidation-resistant film 21 is formed a wear-resistant layer 23 which can protect the thermal printing head from wearing during printing. The layer 23 is made, for example, of tantalum pentaoxide ($Ta_2O_5$), silicon carbide (SiC) or the like. This type of thermal printing head is described, for example, in IEEE, Vol. CHMT-7, No. 3 (September, 1984), p. 294–298. In the thermal printing head of FIG. 5, a portion 19 of the heating resistor 13, which is established between the conductors or electrodes 15 and 17 provided on the heating resistor 13 apart from each other, serves as a heating unit.

In the known thermal printing head having such a structure as described above, the specific resistance of the tantalum nitride ($Ta_2N$) is not larger than about 300 micro-ohms·cm. If the heating resistor 13 is designed to have a thickness sufficient to stand use over a long time period, the resistance of the heating resistor becomes smaller than a desired resistance of, for example, about $10^2$ to $10^5$ micro-ohms·cm. Moreover, when any protective layer for the heating resistor is not provided as an oxidation-resistant film or when the thickness of the protective layer is not sufficient, the application of energy necessary for the printing to the heating resistor 13 (hereinafter referred to simply as application energy) will increase the resistance of the heating resistor by the action of the oxidation of the resistor, resulting in deterioration of the heating resistor. This leads to a disadvantage in that the thermal printing head enables one to allow thermal printing only within a very short time period.

On the contrary, when the protective layer is made thicker than as required, the thermal response of the thermal printing head at the time of application or termination of an electric current supplied to the heating resistor remains dull, with an attendant disadvantage in that high speed printing is not possible.

For reproducible thermosensitive transfer printing to which attention has been drawn recently, higher application energy than the energy used in known thermal printing heads is necessary for printing through a film. This requires a larger electric current to be supplied to the heating element so as to ensure satisfactory printing energy.

However, because of the limitations on a circuit and a driving technique for the thermal printing head, a resistor has to be designed of such a form as to give a practical resistance upon application of a limited electric current.

FIGS. 6A and 6B are, respectively, schematic plane views showing heating resistors as used in FIG. 5. In order to effectively operate the heating resistor by application of a limited current, there has now been used a meander-type heating resistor of FIG. 6B, instead of a rectangular heating resistor of FIG. 6A, so that the resistance is increased. However, the heating resistor of the meander form shown in FIG. 6B is more complicated in shape as is seen from the figures. For realization of printing of a higher accuracy, a finer and more accurate shape of the resistor is required, presenting the problem in that a limitation is placed on processing techniques.

Developments of heating resistors have now been made on a variety of compounds used as electrically insulating materials instead of tantalum nitride ($Ta_2N$). In one such heating resistor, silicon nitride (SiNx) or silicon oxide (SiOx) is used as an electrically insulating material and tantalum (Ta) is used as a conducting material. However, these materials are not satisfactory with respect to resistances to heat and oxidation.

SUMMARY OF THE INVENTION

It is accordingly an object of the invention to provide a heating resistor adapted for use in a thermal printing head which can solve the problems involved in prior art counterparts.

It is another object of the invention to provide a heating resistor whereby a thermal printing head using the heating resistor is suitable for high speed printing operations having a good print quality.

It is a further object of the invention to provide a heating resistor adapted for a thermal printing head which is imparted with good durability.

It is a stll further object of the invention to provide a method for making such a heating resistor as mentioned above.

The heating resistor according to the invention comprises a conductive material, and an electrically insulating material made of a mixture of silicon carbide (SiC) and carbon (C) which has a carbon content of not less than 3 wt % based on the mixture. The conductive material is preferably at least one metal selected from tantalum (Ta), titanium (Ti), niobium (Nb), tungsten (W), molydbenum (Mo), zirconium (Zr) and chromium (Cr).

The heating resistor is formed by a sputtering method which comprises providing a target of a conductive material and an electrically insulating material made of a mixture of silicon carbide (SiC) and carbon (C) which has a carbon content of not less than 5 wt % of the mixture, and subjecting the target to sputtering, thereby forming a resistor layer on an electrically insulating substrate. For the sputtering, it is preferred that a target made of silicon carbide and carbon and a target of the conductive material are put one on another in such a way that one target is provided as a base target and another target with a smaller size or area is superposed on the one target while leaving at least a part of the base target exposed. By this method, simultaneous sputtering of both targets becomes possible. Alternatively, carbon may be added to both targets provided that the total amount of the carbon added to both targets is within a defined range in relation to the silicon carbide used as an electrically insulating material. Since carbon is added to silicon carbide used as an electrically insulating material, the resultant heating resistor has improved resistances to heat and oxidation. It should be noted that when an electrically insulating material containing about 5 wt % of carbon is sputtered, the carbon content reaches approximately 3 wt % in a final resistor product as determined by electron probe microanalysis.

The above and other objects, features and advantages of the present invention will become more apparent from the following description taken in conjunction with the accompanying drawings.

DETAILED DESCRIPTION AND EMBODIMENTS OF THE INVENTION

Figure 1:
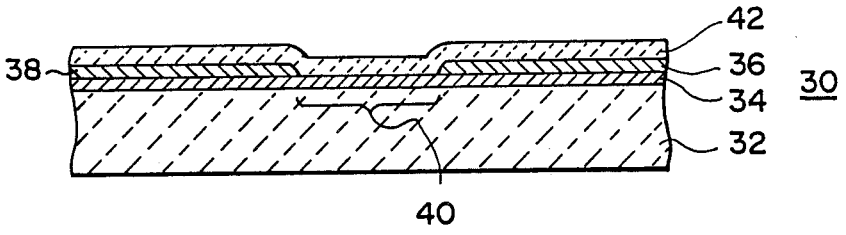
FIG. 1 is a schematic sectional view of an essential part of a thermal printing head using a heating resistor according to the invention.
Figure 2:
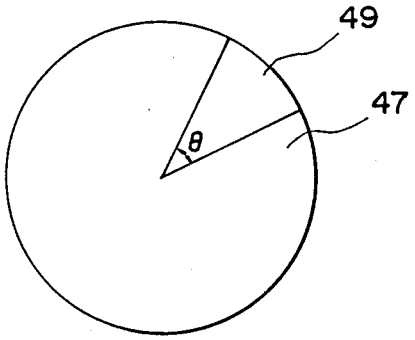
FIG. 2 is a view illustrating a method embodying the invention.

Reference is now made to the accompanying drawings and particularly to FIGS. 1 and 2. It should be noted that these figures are shown only schematically for illustrating the present invention and the size, shape and arrangement of the respective layers or members are not necessarily shown accurately.

FIG. 1 shows a thermal printing head including a heating resistor according to the invention. Similar to FIG. 5, only one resistor among a great number of heating resistors formed on an insulating substrate is shown in this figure.

In FIG. 1, there is generally shown a thermal printing head 30 which includes an insulating substrate 32 and a heating resistor 34 formed on the substrate 32. Electrodes 36, 38 are formed on the heating resistor 34 so that they are kept apart from each other while exposing a part of the heating resistor 34 therebetween to establish a heating portion 40. Over the electrodes 36, 38 and the portion 40 is directly formed a wear-resistant film or layer 23.

The heating resistor 34 is made of at least one metal selected from Ta, Nb, Ti, W, Mo, Zr and Cr and an electrically insulating material of silicon carbide mixed with carbon. The at least one metal is preferably contained in an amount sufficient to give a specific resistance of from $10^2$ to $10^5$ micro-ohms·cm to the resistor layer or in an amount of from 45 to 70 wt % of the total resistor composition.

The content of the carbon in the mixture of the carbon and the silicon carbide is generally not less than 3 wt % preferably from 10 to 20 wt %, of the mixture. The heating resistor 34 used for this purpose may have a thickness of from 1500 to 6000 angstroms in order to impart a resistance sufficient for use as the thermal printing head.

The insulating substrate 32 may be made of any known insulating materials such as alumina. The electrodes 36, 38 may be made of ordinary materials such as gold, chromium and the like. Moreover, the wear-resistant layer 42 may be tantalum pentaoxide or silicon carbide as used in prior art.

Figure 5:
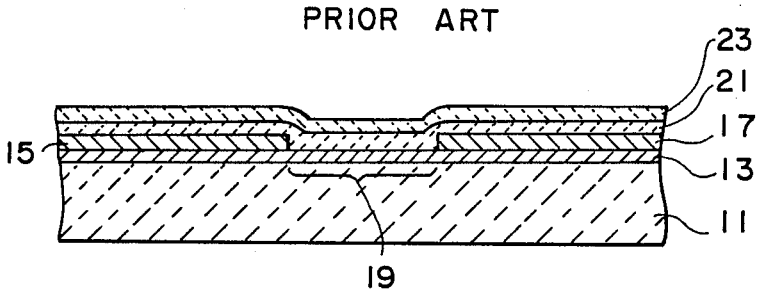
FIG. 5 PRIOR ART
FIG. 5 is a schematic sectional view showing an essential part of a known thermal printing head.
Figure 6A:
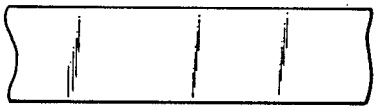
FIG. 6(A) PRIOR ART
FIGS. 6A and 6B are, respectively, schematic plane views showing shapes of heating resistors.
Figure 6B:
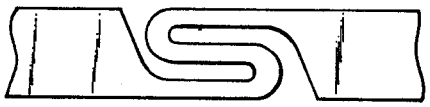
FIG. 6(B) PRIOR ART

Because the heating resistor 34 according to the invention has a good durability, any oxidation-resistant layer as used in the prior art resistor illustrated in Fig. 5 is not necessary, but the wear-resistant film or layer 42 can be directly formed on the electrodes 36, 38 and the heating portion 40.

The fabrication of the heating resistor 30 according to the method of the invention is described.

First, a target is provided, which is comprised of at least one metal as defined above and an insulating material of silicon carbide to which carbon such as graphite is added at a predetermined ratio. This target is subsequently subjected to sputtering, such as RF magnetron sputtering, to form a resistor film on the insulating substrate. The sputtering is effected under conditions known in the art, e.g. a reduced pressure of $1\times10^{-1}$ to 10 Pa., a sputtering power of 0.5 to 10 w./cm$^2$, a substrate temperature of up to 500° C., and a film forming rate of from 5 to 120 angstroms/minute. As a matter of course, the sputtering is carried out in an inert gas such as argon. The target may be a mixture of all the ingredients of the at least one metal, silicon carbide and carbon, which has been molded as described. Preferably, a mixture of silicon carbide and carbon is molded, for example, into a base target of a desired form such as a disk and the at least one metal is separately molded into a chip of a smaller size, for example, with a fan-shaped form. The chip is superposed on the base target, followed by the sputtering. This superposition is particularly illustrated in FIG. 2, in which the base target is indicated by 47 and has a disk form, and the chip is indicated by 47 and has a fan-shaped form. The concentration of the at least one metal can be arbitrarily controlled by changing an angle $\theta$, of the fan-shaped chip. This is why the superpositin technique is preferred in the practice of the invention. Moreover, carbon may be added to the conductive material chip while it is also incorporated into the base target 47. Because the carbon is, more or less, lost during the sputtering operation, its content in the target or targets has to be at least 5 wt % of the mixture of carbon and an electrically insulating material. By this method, a final heating resistor is enabled to have a carbon content of 3 wt % or more based on the mixture when determined by electron probe microanalysis.

The present invention is more particularly described by way of examples.

EXAMPLE 1

A Ta-Si-C resistor film was formed on an alumina ceramic insulating substrate by RF sputtering, in which various compositions were used to form the resistor film.

Base targets were formed by molding mixtures of silicon carbide and carbon at different mixing ratios of from 0 to 30 wt % of carbon, based on the total of the silicon carbide and carbon, into a disk form 47 as shown in FIG. 2. Tantalum was also molded into a fan-shaped chip 49 with different central angles as shown in FIG. 2. The chip was superposed on the respective base targets and subjected to RF sputtering in an argon gas under conditions of a reduced pressure of $5\times10^{-1}$ Pa., a sputtering power of 7.4 w/cm$^2$, a pre-heating temperature of 200° C. and a sputtering rate of 60 to 100 angstroms/-minute. It should be noted that the carbon contents of 20 and 30 wt % in the base target respectively correspond to about 11 wt % and about 18 wt % of the total of SiC in deposited films.

The central angle of the fan-shaped chip was varied from 30 to 40 degrees so that the surface resistance of the heating resistor was about 150 ohms/square. The content of the tantalum in the heating resistors was controlled to range from about 45 to 70 wt %. Moreover, the respective heating resistors had a thickness of 3000 angstroms and were formed on the insulating substrate as a pattern with a size of 180 micrometers$\times$160 micrometers according to a known etching technique.

Subsequently, electrodes were formed on each heating resistor as shown in FIG. 1, followed by formation of a 3 micrometer thick silicon carbide wear-resistant layer.

Figure 3:
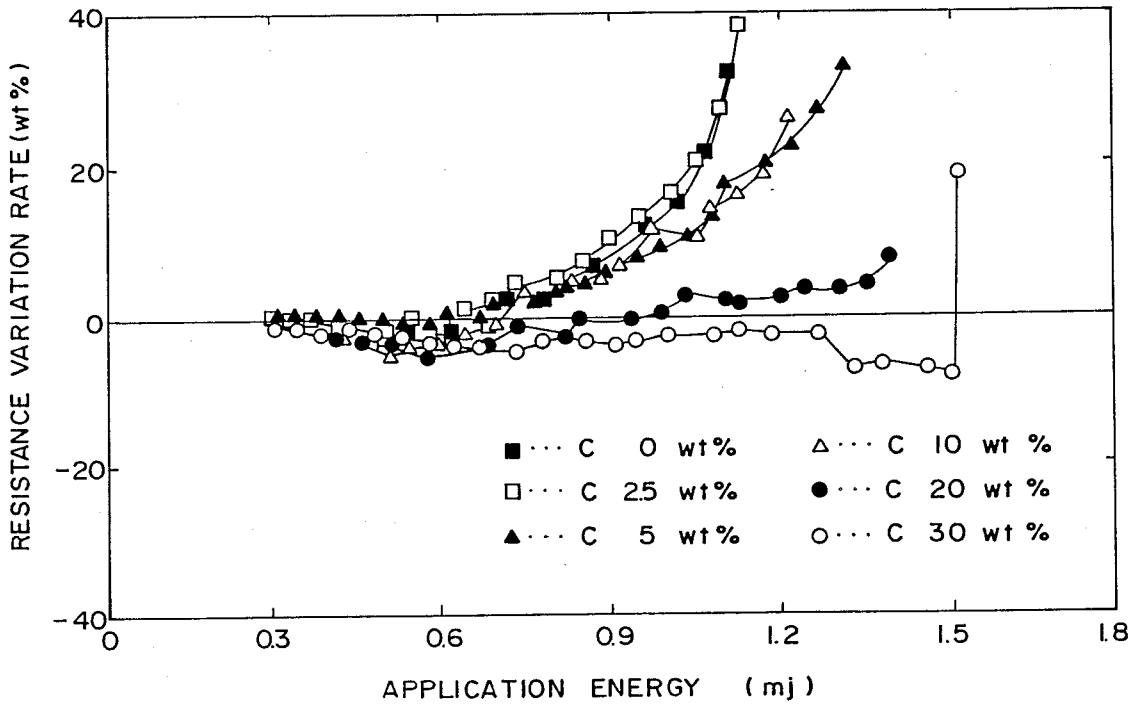
FIG. 3 is a graphical representation of characteristic curves of heating resistors according to the invention.

The resultant thermal printing heads using the heating resistors having a content of the carbon added to the silicon carbide of from 0 to 30 wt %, i.e. 0 to 18 wt % in the heating resistors, were each subjected to a life test. The life was evaluated by a step stress test (SST) where 20,000 pulses having a pulse width of 1.60 msec., and a repetition time of 2.76 msec, were continuously applied to the head. The results are shown in FIG. 3, in which the axis of ordinates indicates a resistance variation rate by percent and the axis of abscissas indicates applied energy as mJ. In the figure, the content in the target of the carbon added to the electrically insulating material was 0 wt %, i.e. C/SiC=0, for the mark ■, 2.5 wt %, i.e. C/SiC=0/0256, for the mark □, 5 wt %, i.e. C/SiC=0.0526, for the mark ▲, 10 wt %, i.e. C/SiC=0.111, for the mark △, 20 wt %, i.e. C/SiC=0.250, for the mark ● and 30 wt %, i.e. C/SiC=0.429, for the mark ○. The resistance variation rates for these contents are shown in the figure. It will be noted that the resistance variation rate was determined in the following manner: each heating resistor was subjected to measurement of its resistance whenever a predetermined number of pulses were applied in the respective steps; an amount of a resistance variation rate, R, of the heating resistor was calculated from the measured resistance and a resistance, $\Delta R$, determined prior to the test; and the resistance variation rate relative to the resistance prior to the test, $\Delta R/R$, was determined.

As will be seen from the figure, when the content of the carbon in the electrically insulating material of the base target is not less than 5 wt % (not less than 3 wt % for a final resistor), the resistance variation rate, $\Delta R/R$, is significantly improved. Moreover, when the content of the carbon exceeds 20 wt %, the variation in resistance is small even at high application energy. Accordingly, the content of carbon to be added to the silicon carbide insulating material of the base target is preferably from 20 wt % to 30 wt %. This is because at over 30 wt %, the etching rate lowers with an attendant problem with respect to processability. The carbon content of 20 to 30 wt % in a base target corresponds to a carbon content of about 10 to 20 wt % in a final heating resistor.

EXAMPLE 2

Figure 4:
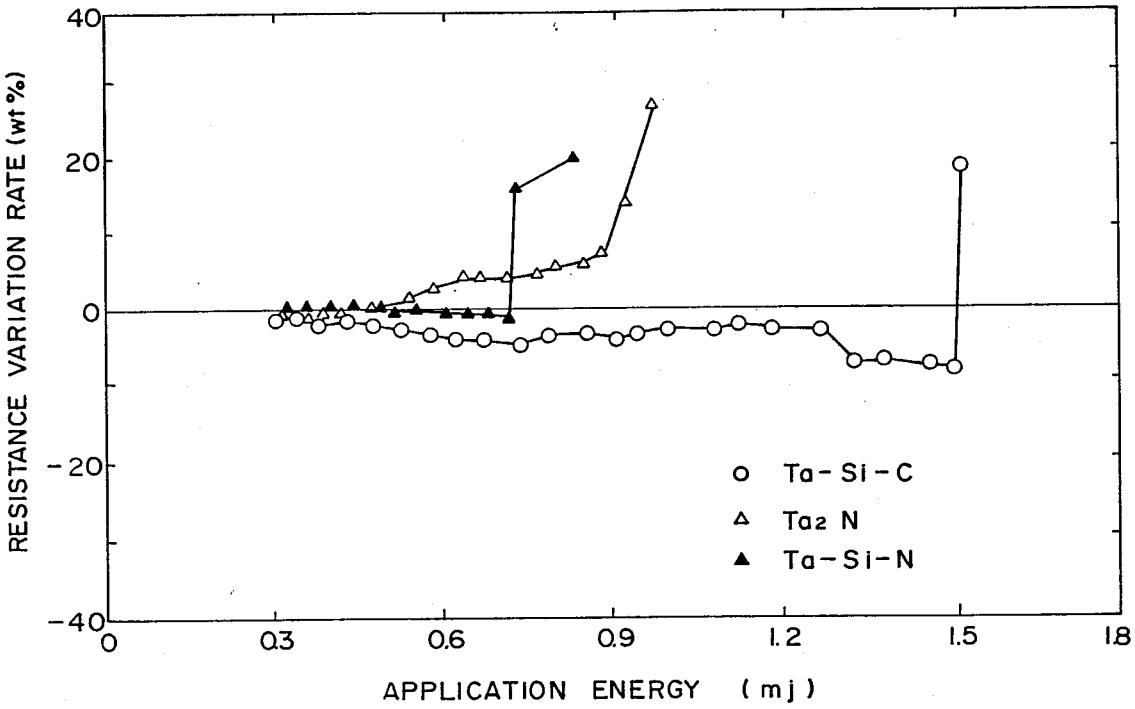
FIG. 4 is a graphical representation of characteristic curves of heating resistors of the invention and for comparison.

Example 1 was repeated for making thermal printing heads except that heating resistors were made of tantalum nitride ($Ta_2N$) and a mixture of silicon nitride and tantalum (Ta-Si-N), both for comparison, and also of Ta-S-C according to the invention in which an amount of carbon added to silicon carbide as an electrically insulating material in a base target was 30 wt %, respectively. The thermal printing heads were each subjected to the step stress test in the same manner as in Example 1. The results are shown in FIG. 4. Similar to FIG. 3, FIG. 4 shows characteristic curves of the respective thermal printing heads in which the axis of ordinates indicates a resistance variation rate, $\Delta R/R$, and the axis of abscissas indicates application energy. In the figure, the curve "○" is for Ta-Si-C of the invention, the curve "△" is for $Ta_2N$, and the curve "▲" is for Ta-Si-N. The results reveal that the heating resistor of the invention using silicon carbide as an electrically insulating material to which carbon is added suffers less deterioration than the known heating resistors when high application energy is applied.

In the foregoing examples, the ratio by weight of carbon and silicon carbide in a base target is described within a range of from 0.0526 to 0.429:1, which corresponds to from 5.0 wt % to 30 wt % of carbon in the total composition of the carbon and the silicon carbide. Similar results are obtained when the ratio exceeds about 0.05:1. In this connection, however, a heating resistor is generally formed into a described pattern by the use of etching techniques, whereupon when the content of carbon is too high, the etching rate undesirably lowers.

Moreover, tantalum was used in the examples, and similar results are obtained using at least one metal ordinarily used in the art and selected from tantalum, niobium, titanium, tungsten, molybdenum, zirconium and chromium.

Although the heating resistors having a surface resistance of about 150 ohms/square were illustrated, they may be formed to have a practical resistivity value in the range of from about $10^2$ to $10^5$ micro-ohms·cm.

In addition, sputtering may be effected using several types of targets. For instance, as used in the examples, a base target is made of a mixture of silicon carbide and carbon and a fan-shaped target superposed on the base target is made of tantalum or the like metal alone. The fan-shaped target may further comprise carbon. Alternatively, only one target may be used, which contains carbon, silicon carbide and tantalum or the like metal.

The heating resistor using an electrically insulating material of silicon carbide to which carbon is added has a number of advantages in that it is resistant to heat and oxidation and in that when high energy is applied to the resistor, the variation in resistance is very small. When the heating resistor is applied as a thermal printing head, a protective layer of a known double structure including an oxidation-resistant layer and a wear-resistant layer is not necessary, but instead only one wear-resistant layer is used as the protective layer. The thermal printing head using the heating resistor of the invention is more durable and is made more accurately with a better thermal response than known couterparts.

The method of the invention is also advantageous in that a heating resistor having a desired specific resistance can be readily fabricated by changing a content of a conductive material or metal in the resistor. The resistor film formation is easy since a conductive metal and an electrically insulating material are simultaneously sputtered in an inert gas. As described before, the carbon content in a base target, differs from a carbon content of a final heating resistor, but other ingredients in a heating resistor including SiC and a metal used have substantially the same contents as in a starting target or targets.

Although the invention has been described in its preferred form with a certain degree of particularly, it is to be understood that many variations and changes are prossible in the invention without departing from the scope thereof.

What is claimed is:

1. A heating resistor comprising:

a conductive material made of at least one metal selected from the group consisting of tantalum, titanium, niobium, tungsten, molybdenum, zirconium and chromium; and, an electrically insulating material made of a mixture of silicon carbide and carbon having a carbon content of not less than 3 wt % based on the mixture;

wherein said at least one metal is used in an amount of 45 to 70 wt % of the total of said at least one metal and said electrically insulating material.

2. A thermal printing head comprising a heating resistor, wherein said heating resistor comprises:

a conductive material made of at least one metal selected from the group consisting of tantalum, titanium, niobium, tungsten, molybdenum, zirconium and chromium; and, an electrically insulating material made of a mixture of silicon carbide and carbon having a carbon content of not less than 3 wt % based on the mixture;

wherein said at least one metal is used in an amount of 45 to 70 wt % of the total of said at least one metal and said electrically insulating material.

* * * * *